United States Patent [19]

Dunn, Jr. et al.

[11] Patent Number: 4,549,735

[45] Date of Patent: Oct. 29, 1985

[54] SIDE RAIL FOR OUTDOOR BUMPER POOL TABLE

[76] Inventors: Edward G. Dunn, Jr., 136 E. 50th St., Indianapolis, Ind. 46205; Edward G. Dunn, Sr., 7701 Spring Mill Rd., Indianapolis, Ind. 46260

[21] Appl. No.: 611,337

[22] Filed: May 17, 1984

[51] Int. Cl.[4] ..... A63D 15/06

[52] U.S. Cl. ..... 273/9

[58] Field of Search ..... 273/4 B, 5 A, 8, 9, 273/13, DIG. 29, 3 R, 4 R, 5 R, 6, 7

[56] References Cited

U.S. PATENT DOCUMENTS

| | | | |
|---|---|---|---|
| 1,652,671 | 12/1927 | Hoskin | 273/8 |
| 3,489,410 | 1/1970 | Stillman | 273/9 X |
| 3,729,192 | 4/1973 | Nielsen | 273/7 |

*Primary Examiner*—Harland S. Skogquist

*Attorney, Agent, or Firm*—Woodard, Weikart, Emhardt & Naughton

[57] ABSTRACT

A side rail for an outdoor pool table includes a silicone rubber cushion member which is formed with a recessed portion providing a first method of interlocking, a synthetic material backing member formed with a second contoured portion which is mutually engageable with the first contoured portion for providing an interlocking assembly between the cushion member and the backing member. The subassembly of the cushion member and the backing member is disposed within a sewn acrylic fabric cover. This sewn construction defines an interior receiving pouch which has an interior peripheral dimension of sufficient size to slidably receive the cushion member and backing member assembly. In order to mount this fabric-covered subassembly to the pool table, a synthetic material support strip is applied directly against the lower portion of the backing member and threaded fasteners are received by the surrounding portion of the pool table. The support strip acts as a clamp clamping the backing member and the cushion member which is assembled thereto directly against the surrounding boundary of the pool table. By accurately controlling the peripheral dimension of the fabric cover, there will exist an interior void between the cover and the cushion which is eliminated by the support strip which stretches the cover taut around the cushion and backing members.

7 Claims, 8 Drawing Figures

SIDE RAIL FOR OUTDOOR BUMPER POOL TABLE

BACKGROUND OF THE INVENTION

The present invention relates in general to pool tables and to bumper pool tables which are uniquely adapted to be portable and usable outdoors. More particularly, the present invention relates to essential parts of such tables.

Conventional pool tables typically include a slate, concrete, or honeycomb bed covered with felt and the frame is constructed of wood, metal, fiberglass, or a combination of these materials. While the weight of the pool table is important to the overall stability, the construction of the frame is critical for the support of the slate bed and for stabilizing this slate bed in order to provide a true and level top playing surface. While current-day "felt" is frequently a blended synthetic fiber, it may still be adversely affected by wear, contact with debris and moisture. By all normal concepts and interpretations, these conventional pool tables are never used outdoors nor intended for such use because of their size and weight and because of their susceptibility to environmental conditions such as rain and snow. Pool tables which have been designed for use outdoors have been of sturdy and heavy construction employing concrete slabs. These tables are heavy and nonportable and some use liquid support and leveling means for the heavy concrete surfaces. Furthermore, they are not of a knockdown type wherein the table is easily assembled or disassembled for moving or storage.

An alternative pool table concept which has found certain acceptance due to its smaller size, lighter weight and lower cost is a bumper pool table. These types of pool tables are considerably smaller and lighter in weight than conventional, regulation pool tables and provide a different game format and different game rules. Bumper pool tables typically have an octagonal-shaped top playing surface, a base and a series of raised bumpers which play an active part in the actual game. While such bumper pool tables are generally smaller than conventional pool tables, they are still not suitable for outdoor use because of their weight, and because they are neither designed nor constructed to withstand an outdoor environment. These tables also are not of knockdown construction and are therefore not easily assembled and disassembled into component parts which can be easily moved or stored.

While pool tables and bumper pool tables alike provide an excellent form of recreation, their use is limited to indoors and usually in a fixed location and thus they are typically not used during good weather nor during such occasions as swimming and lawn parties and cookouts. Furthermore, outdoor pool tables have not been portable and can only be used in one location and are not easily disassembled and moved to another location or stored out of the way when use is not desired.

If a portable pool table or a portable knockdown bumper pool table, could be designed and constructed to be used outdoors, it would provide an excellent form of recreation for the above types of gatherings which is not now available. The limited space requirements for playing bumper pool provides a strong incentive for designing a bumper pool table which is both portable and suitably constructed for use outdoors. However, there are certain design constraints envisioned for such a product including the fact that the unit must be waterproof, portable, able to be leveled and able to tell when the playing surface is level, means to secure the table to prevent theft and storage space for the cues and balls. Further, the portable table would have to have means for increasing its weight for proper stability and non-portability when it is in use and means for decreasing its weight and portability when it is moved from outdoors to indoors. One such suitable portable, outdoor pool table is disclosed in our prior, co-pending patent application, Ser. No. 462,626, filed Jan. 31, 1983.

While portability is one aspect of outdoor use, the proper selection of materials is believed to be equally important, if not more important. In the event a user elects not to move the table, such as indoors, its ability to withstand a variety of weather conditions becomes critical. While weather resistant materials exist, the selection of a suitable material must take into consideration assembly of those materials and whether or not their use will have an effect on the game. For example, if silicone rubber is selected, then glueing cannot be used as an assembly option. The result is to force some other type of assembly technique.

The present invention discloses one component part of a pool table construction wherein the selection and use of materials is made so that the table will be suitable for prolonged outdoor use while not sacrificing the durability of construction and reproducibility of game effects and responses.

The following patents may have some relevance to the present invention, but they do not anticipate or render the present invention obvious:

| Patent No. | Inventor | Title |
|---|---|---|
| 3,941,378 | Bagley | Convertible Pool Dining Table with Retractable Ball Box |
| 3,837,645 | Criswell | Playing Table with Base for Molding Fluid Therein |
| 3,658,328 | Kooker | Pool game tables and components for use therein |

The Bagley patent discloses an indoor dining room table/bumper pool table. This table is intended to convert from a dining room table to a bumper pool table. Criswell discloses an outdoor regulation pool table which uses a concrete slab for the playing surface. The concrete slab's weight is supported by and leveled by liquid contained in the multi-pedestal support arrangement which is disposed beneath the concrete slab. Criswell provides a sturdy and solid outdoor table which would resist the weather and the wear and tear of outdoor use. The table is set up in a fixed location and is not portable or of a knockdown construction. While not a bumper pool game, Kooker discloses a single pedestal pool game structure and components made by casting concrete. Kooker provides for ball return passageways that are formed during the casting which collect the balls in a central location and then deliver them to a collection tray extending from the pedestal. The table is not intended to be of a knockdown and portable nature because it is cast of concrete and shown embedded in the ground. Further, Kooker's leveling means rest above the unsecured pedestal cap and the pedestal and the top portion is supported in a direct line with the pedestal.

Since none of the foregoing references adequately address the concept of an outdoor, portable pool table, it is not surprising that they are each silent as to the need to accurately select specific materials and how to incorporate those specific materials into the pool table structure.

SUMMARY OF THE INVENTION

A pool table side rail suitably styled for prolonged use outdoors as part of a pool table according to one embodiment of the present invention comprises a cushion member formed with a first contour portion providing first interlocking means, a backing member formed with a second contoured portion providing second interlocking means which are mutually engageable with the first interlocking means therebiy creating an interlocked assembly of the cushion member and the backing member, a fabric cover closed at one end and initially open at the opposite end and defining a receiving pouch therein for slidably receiving the cushion member and backing member assembly and a support strip disposed adjacent one side of the fabric covered backing member and being attachable to the pool table.

One object of the present invention is to provide an improved side rail for use as part of an outdoor pool table.

Related objects and advantages of the present invention will be apparent from the following descriptions.

DESCRIPTION OF THE PREFERRED EMBODIMENT

Figure 1:
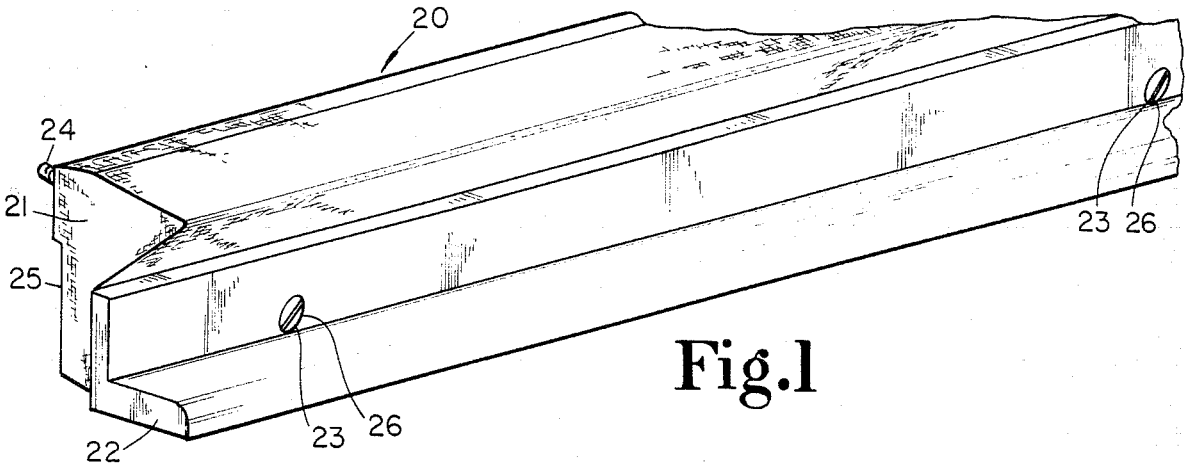
FIG. 1 is a partial perspective view of a pool table side rail according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
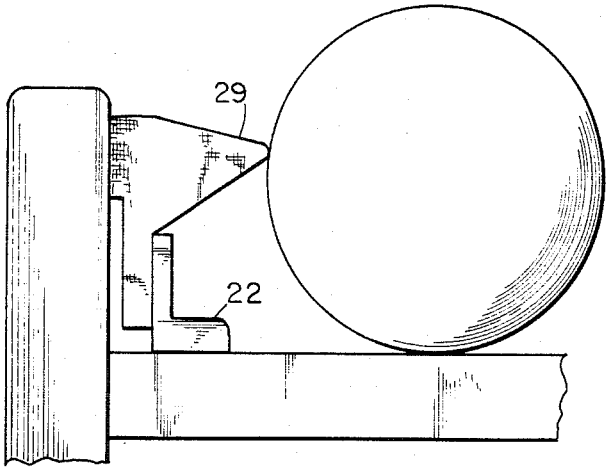
FIG. 6 is a partial, side elevation view of the FIG. 1 pool table side rail as positioned as part of an outdoor pool table.

Referring to FIG. 1, there is illustrated a pool table side rail which is suitably styled for prolonged use outdoors as part of a pool table. The actual placement of this pool table side rail 20 as part of a pool table is illustrated in FIG. 6. Those component parts illustrated in FIG. 1 include a fabric cover 21, a plastic support strip 22, and a pluraity of threaded fasteners 23 which in the exemplary embodiment are flathead screws. As is illustrated in FIG. 1, screws 23 extend through clearance holes in both the support strip 22 and the subassembly which is disposed within the fabric cover 21. As is shown, the leading end 24 of screw 23 extends sufficiently beyond outer wall 25 such that this portion of screw 23 can then be used as the means to secure side rail 20 in its appropriate location as part of an outdoor pool table. This is the positioning and assembly technique which is illustrated in FIG. 6. Holes 26 provide clearance for screws 23 and the entry portion of hole 26 is properly countersunk to receive and retain in a flush-to-slightly-recessed condition the flat head portion of screw 23.

Figure 2:
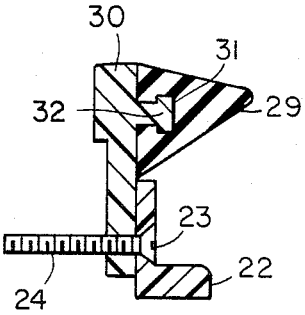
FIG. 2 is a side elevation view of the FIG. 1 side rail as illustrated in full section.
Figure 3:
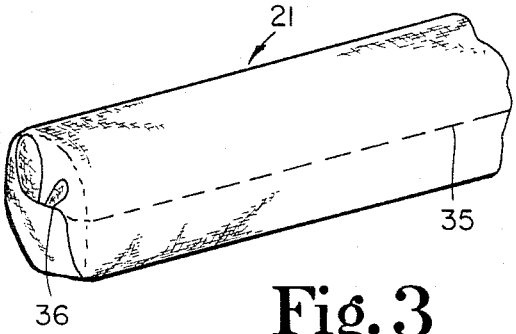
FIG. 3 is a partial perspective view of a fabric cover comprising a portion of the FIG. 1 pool table side rail.

Referring to FIG. 2, the component parts which are disposed within cover 21 are illustrated in greater detail. For the purposes of the FIG. 2 illustration, the fabric cover 21 has been removed from the side rail illustration. The two component parts which are retained within fabric cover 21 in the FIG. 1 illustration include silicone rubber cushion member 29 and synthetic material backing member 30. As is illustrated, cushion member 29 which has an inwardly directed wedge-shaped portion also includes a specially contoured and recessed portion 31, configured somewhat similarly to a keyway. In a related manner, though in a reverse sense, backing member 30 which has a substantially flat outer surface also includes its own contoured portion 32, configured somewhat similarly to a key. As should be understood from the illustration and as is intended, the two contoured portions provide first and second interlocking means which are mutually engageable, one with the other, thereby creating an interlocked assembly between cushion member 29 and backing member 30. Additionally, as should be understood, these two component parts are manually assembled together by beginning at one end and sliding the two contoured portions together for the full length of the corresponding side rail with their respective portions properly engaged.

At this point, it is appropriate to comment on the length of the side rail which is illustrated in FIGS. 1 and 2. Inasmuch as the particular side rail comprises a portion of the pool table, the length will be dependent upon the size and peripheral geometry of the pool table. In the event this side rail construction is used with a conventional rectangular pool table, then there would be a minimum of four such side rails as part of the pool table assembly, the end rails being of the same length and the other two rails being of approximately twice the length of the end rails. It is also conceivable, in order to reduce the overall length of any one side rails, that the length dimension may be shortened by utilizing two or more individual side rail segments for any one side. However, this approach is not felt to be as desirable as a single unit due to the abutment edge which results, and the desire to eliminate such interfaces or edges.

In the event this particular side rail style of construction is incorporated as part of a bumper pool table, the length of each side rail depends on the style of table. In the exemplary embodiment, it is intended that the side rail be used on a bumper pool table having an octagonal configuration and one which is intended for use outdoors. Consequently, the material selection for use with the side rail becomes critical. In order to create the octagonal shape there needs to be a selected angular face on each end of the side rail so that as adjacent side rails abut one another in the corners they form the octagonal shape. With an octagonal-shaped bumper pool table, there needs to be formed on each end of each side rail a 22½° angular face.

Continuing with the FIG. 2 illustration, support strip 22 is properly disposed contiguous to the lower portion of the backing member and directly against this inwardly facing surface. It is this lower portion of the backing member which includes suitably sized clearance holes for receipt of the various screws 23. Depending upon the desired style for the pool table, screws 23 may be captured by an internally threaded hole disposed within the surrounding portion of the pool table against which the side rail is assembled, or alternatively, a thinner wall may be disposed at that location allowing the leading edge of the screw to extend through, at which point it is secured in place by a hex nut or similar internally threaded fastener.

Since it is intended that this disclosed side rail will be used as part of a bumper pool table which may remain outdoors for prolonged periods of times, a number of design and manufacturing constraints exist due to the exposure of the device to the elements. For example, it has been found that the cushion member 29 should be constructed of silicone rubber in order for it to remain playable over a wide range of temperatures and for it to remain consistent as to its material properties over prolonged periods of time. One difficulty though with the use of silicone rubber is that it is not a material that lends itself to use with glue for assembly to other parts. Consequently, one hurdle to be overcome with the present invention was to devise a means by which this silicone rubber cushion member could be secured to its backing member 30. This task was solved by the unique assembly concept employing the two contoured portions 31 and 32 which are mutually engageable with each other by sliding them together from end to end.

Another constraint, though not related as directly to the outside environment as to the game itself, is the degree or amount of spring which the side rails will impart to the pool balls as the balls strike against the side rails and rebound back into the playing surface. If too great a thickness of silicone rubber is used or if a rigid backing is not provided, the game balls will rebound more wildly and faster very likely putting too much play into the game and thus the game will not be representative of a normal game of pool. Backing member 30 is a more rigid member which controls the amount of spring in the cushion member by using a material other than silicone rubber. The material of backing member 30 is suitable for rigidly retaining the cushion member in its desired position and orientation. Rigid support strip 22 serves as a clamp to hold the cushion member and backing member subassembly in position against the surrounding portion of the pool table.

Another constraint which is presented by the fact that the disclosed side rail 20 is used as part of an outdoor bumper pool table is the limitation on the type of fabric cover which may be used. The material that is used on the table will also be used as a covering for the corresponding side rails, and one material which is suitable for prolonged use outdoors is an acrylic fabric. However, the nature of this fabric is such that it cannot be glued nor stapled, and thus the more conventional methods of attaching a fabric (usually felt) cover to an indoor pool table simply are not available for the disclosed outdoor table.

The acrylic fabric cover which is used to cover the cushion member and backing member of side rail 20 begins as an elongate panel of material with an overall length sufficiently in excess of the side rail length so as to provide material at each end for enclosing the cushion member and backing member assembly. Once the desired length of acrylic fabric is selected, it is cut to a particular width and then folded onto itself and a longitudinal seam 35 is sewn. End 36 is then folded over and sewn into a closed condition thereby configuring fabric cover 21 as a pouch-like member whose internal peripheral dimensions is sufficiently large to slidably receive the cushion member and backing member subassembly. The particular inside peripheral dimension of the cover is critical relative to the outside peripheral dimensions of the cushion member and backing member subassembly.

Figure 4:
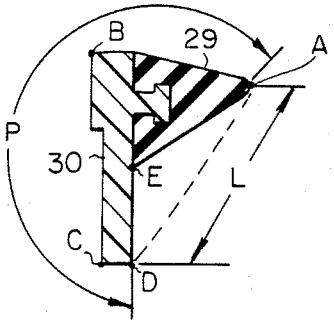
FIG. 4 is a diagrammatic illustration of various peripheral dimensions relating to the FIG. 1 pool table side rail.

Referring to FIG. 4, cushion member 29 and backing member 30 are diagrammatically illustrated. For the purposes of explaining the importance of the dimensional relationshp between cover 21 and the subassembly of FIG. 4, five different points will be utilized in the description. Beginning at point A, this represents the inner most edge of the cushion member and this is the edge or corner where the pool balls will strike as they are driven into the side rail and rebound therefrom back into the area of play on the table. Point B represents the outermost and uppermost corner of the assembly while point C is the lower and outermost corner. Point D represents the lowermost and innermost corner of the subassembly while interior point E represents the junction or interfacing edge between cushion member 29 and backing member 30. Dimension P is intended to extend from point A to point D traveling across and contiguous to the intermediate surfaces of the subassembly. Dimension L is intended to be a straight line dimension through space from point A to point D. It should be understood in each of these discussions that when reference is made to a point, that is a term of convenience due to the two-dimensional nature of the illustration when in fact the points have length and would actually denote edges extending the full length of the corresponding side rail. The total length of dimensions P and L represents the minimum internal peripheral lateral dimension for cover 21. If the cover was initially sewn and arranged in a cylindrical configuration, then the dimension sum of lengths P and L would represent a minimum internal circumference for the cover. With the cover being of at least this dimension, it is to be understood that it will be able to slidably receive the cushion member and backing member subassembly. When this receipt takes place, a portion of the fabric comprising cover 21 extends between points A and D, but will not extend inwardly along the surface defined by points A and E, nor along the surface defined by points E and D. It should also be understood that while some stretching of the fabric is possible, the lateral peripheral dimension of cover 21 cannot realistically be much smaller than the sum of dimensions P and L, if any smaller, or receipt of the cushion and backing member subassembly would be difficult. Consequently, it is envisioned that the cover may be slightly larger, but only to the point of facilitating easy assembly.

A loose fabric covering on the cushion member would be unsuitable for play, due not only to its poor appearance, but also for its lack of predictability and consistency of play. Any fabric gap or wrinkle would impart a variable rebound to the ball and would make the game much less predictable and much less uniform. The task then is how to draw the fabric cover taut around the cushion member and backing member subassembly without the use of glue or staples which are believed to be unacceptable for the fabric which is employed.

Figure 5:
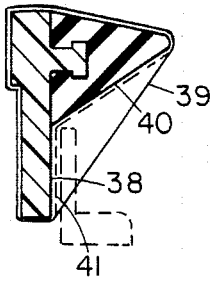
FIG. 5 is a diagrammatic illustration showing the manner in which the fabric cover is stretched around the FIG. 1 pool table side rail.

Fabric cover 21 is drawn taut and snugly against the peripheral surfaces of the cushion and backing member subassembly by the use of support strip 22. As is illustrated in FIG. 5, as the support strip is moved into position and pushed toward the lower portion and flat surface 38 of backing member 30, this support strip will encounter that portion 39 of the fabric cover extending between points A and B. As a support strip is pushed harder and harder against this fabric cover, toward this lower surface 38, the fabric cover will be tautly stretched to the point that it is snug against the entire surface of the cushion and backing member subassembly and will actually extend down and around the lower portion of the cushion member represented by surface 40 between points A and E and will be pushed into contact against the surface 41 defined by points D and E as the support strip is moved into its final position and screws 23 are secured in place.

Figure 7:
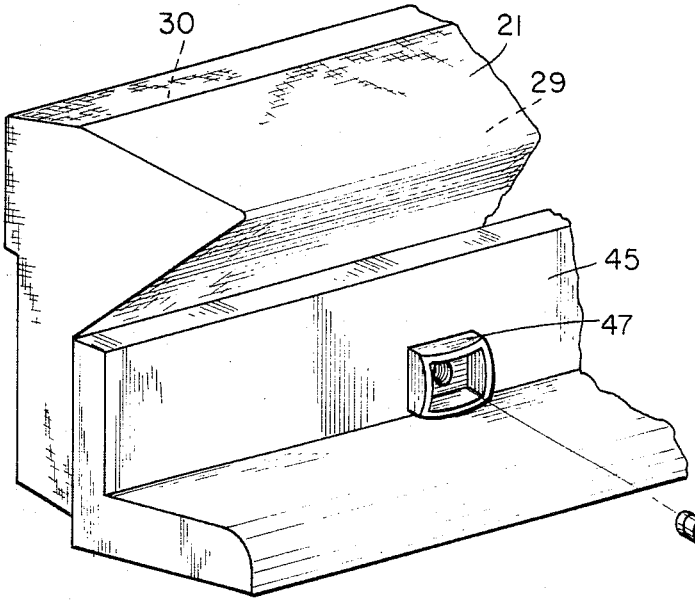
FIG. 7 is a partial perspective view of one alternative for the attachment of the FIG. 1 side rail.
Figure 8:
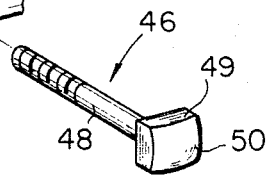
FIG. 8 is a perspective view, in exploded view form with FIG.7, of a fastener designed for use as part of the FIG. 7 alternative.

Referring to the exploded view of FIGS. 7 and 8, an alternative structure of the foregoing description is illustrated. However, it should be understood that virtually all elements of the foregoing description remain the same, including the theory and function of the claimed invention. The only difference is embodied in the use of a different styled support strip 45 and the replacement of screws 23 by means of screws 46. Although FIG. 7 is illustrated in only partial form, it should be understood that support strip 45 extends with a similar shape and contour for its full length, that length being determined by the shape of the pool table with which it is used and the size of that pool table. Similarly, the number of fasteners 46 and fastening locations may vary depending on the design and the preferences of the designer.

The difference between support strip 22 and support strip 45 is found in the presence of generally square boss portion 47. Boss portion 47 is molded as part of support strip 45 and as such is of the same material and of a unitary construction with support strip 45. Boss 47 has a generally square shape though is substantially hollow interiorly. The outer top edge of boss 47 is rounded in both horizontal and vertical directions, the purpose of which will be described hereinafter.

Screw 46 is actually a combination of a conventional metal fastener whose externally threaded body 48 is illustrated. The head portion of this metal screw is enclosed by molded plastic cap 49. By molding this cap onto the head of a conventional metal screw, three things are achieved. First, the externally threaded body of the screw is compatible with the remaining assembly requirements for the side rail. Consequently, whether the support strip and screw combination of FIG. 1 is utilized or that of FIGS. 7 and 8, the remaining elements of the design remain unchanged. The second aspect of fastener 46 is that the peripheral shape of molded head 49 is substantially square and is dimensionally sized and shaped so as to fit snugly within the hollow interior portion of boss 47. Once fastener 46 is fully seated into the hollow portion of boss 47, it should be understood that any tightening of a threaded nut or similar retaining member from the back side of this fastener will not allow the head of the screw to move or rotate. Consequently, the locking aspect of the mutually engaged square shapes provides a holding for the head of the screw allowing full and complete tightening of the nut on the opposite end without the need to otherwise hold or anchor the head from turning.

The final aspect of fastener 46 is that it has a compound curved top portion 50 which is compatible with the vertical and horizontal curved edges surrounding the hollow interior of boss 47. By providing a type of compound curvature to head portion 50, once the molded head 49 is fully seated within boss 47, the curvature of head portion 50 matches the curvature of this surrounding peripheral edge. The resulting effect is an appearance which completely conceals the threaded fastener in a secure and locked manner while at the same time providing the appearance of a molded boss. Since the plastic compound used for head portion 49 is substantially identical to that plastic used for support strip 45 and boss portion 47, the resulting appearance is compatible as to color and texture and appears to provide nothing more than a solid plastic boss on the outer surface of the support strip, but on a surface and in a location that does not in any way affect the playing of the game on the pool table. The relative size of boss portion 47 when compared to the remaining dimensions of support strip 45, or support strip 22, and as they would exist in FIG. 6, clearly shows the fact that they will not and cannot affect the playing of the game.

In this manner, the attachment of the suopport strip serves a dual function. Its first function is to securely attach the side rail to the remainder of the pool table in a rigid and aligned manner. Its second function is to stretch the acrylic fabric cover so as to draw it tightly across the exposed surfaces of the cushion member thereby creating the appearance and the functional performance of a conventional pool table side rail to which felt or similar fabric covering would be tightly stretched and then stapled or glued.

What is provided by the present invention is the means to utilize the essential materials for a outdoor pool table, namely silicone rubber and acrylic fabric, in a manner that does not in any way detract from the performance and capabilities of the pool table. The invention discloses a way to adapt and utilize these materials when conventional assembly and fabrication techniques are not available. As has been illustrated, the present invention utilizes silicone rubber for that component part where it is essential that there be silicone rubber, yet the invention not employ glue at any stage of the construction. Similarly, since felt cannot be used outdoors without rapid deterioration and damage, an acrylic fabric has been employed. Since the acrylic fabric cannot be glued or stapled, it is arranged in a manner that allows it to be tightly drawn around the component parts which it must cover without the use of such glue or staples but only by sewing and a clever utilization of the support strip which draws the cover tightly as it attaches the remainder of the side rail to the pool table.

With regard to the open end of the fabric cover, this is sewn closed after the cushion and backing member assembly is inserted. This open end may alternatively be just simply folded closed and thereafter retained by the abutment to the corresponding that end of the adjacent side rail as part of the overall pool table construction. However, it is felt that the preferred method is to close that open end by sewing.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A multi-component pool table side rail suitably styled for prolonged use outdoors as part of a pool table, said side rail comprising:

a cushion member having a substantially flat outer surface, an inwardly directed wedge-shaped portion and a substantially flat attachment portion, said wedge-shaped portion and said attachment portion defining three inner edges, a first edge being the innermost edge and apex of said wedge-shaped portion, said second edge being the lower and inner corner of said attachment portion and the third edge being the inner corner intersection of said two portions, wherein the peripheral dimension of said cushion member along its surface from the first edge to the second edge via the third edge is larger than the dimension through space from the first edge to the second edge;

a fabric sleeve clsoed at one end and initially open at the opposite end and suitably sized for receiving said cushion member, and wherein the lateral inner peripheral dimension of said fabric sleeve is substantially equal to the peripheral dimension of said cushion member as measured along the cushion member's outer surface from the first edge to the second edge plus the dimension through space from the second edge to the first edge; and a support strip attachable to the pool table and designed and arranged to clamp said fabric cover cushion member to said pool table by being applied to said cushion member against the surface extending between the second and third edges, said application to said surface and attachment to said pool table causing said fabric sleeve to be drawn taut around said closure member.

2. The pool table side rail of claim 1 wherein said wedge-shaped portion is constructed of silicone rubber and includes first interlocking means, and wherein said attachment portion includes second interlocking means, said first and second interlocking means being mutually engageable with one another thereby creating an interlocked assembly of said wedge-shaped portion and said attachment portion.

3. The side rail of claim 2 wherein said fabric sleeve is made from an acrylic material.

4. The side rail of claim 3 wherein said attachment portion and said support strip are made of synthetic material.

5. The side rail of claim 4 wherein said silicone rubber cushion member has a durometer range of between 25 and 35.

6. The side rail of claim 2 wherein said silicone rubber cushion member has a durometer range of between 25 and 35.

7. The side rail of claim 1 wherein attachment portion and said support strip each include a plurality of aligned clearance holes for attachment of said attachment portion and said support strip to said pool table by means of fasteners.

* * * * *